US005227002A

United States Patent [19]

Faust et al.

[11] Patent Number: 5,227,002

[45] Date of Patent: Jul. 13, 1993

[54] APPARATUS FOR APPLYING TAPE TO AN OBJECT

[75] Inventors: Michael C. Faust; James D. Ramacier, both of Hugo, Minn.

[73] Assignee: Minnesota Mining and Manufacturing Company, St. Paul, Minn.

[21] Appl. No.: 835,778

[22] Filed: Feb. 14, 1992

[51] Int. Cl.[5] ..... B65B 51/00

[52] U.S. Cl. ..... 156/468; 156/475; 156/479

[58] Field of Search ..... 156/468, 475, 479; 53/137.2

[56] References Cited

U.S. PATENT DOCUMENTS

| | | | |
|---|---|---|---|
| 2,512,579 | 6/1950 | Long | 156/468 |
| 2,649,221 | 8/1953 | Wagner et al. | 156/468 |
| 3,561,190 | 2/1971 | Derenthal | 53/67 |
| 4,238,269 | 12/1980 | Deering, Jr. | 156/465 |
| 4,789,418 | 12/1988 | Rayl | 156/468 |
| 4,936,945 | 6/1990 | Marchetti | 156/468 |

FOREIGN PATENT DOCUMENTS

| | | |
|---|---|---|
| 0045262 | 3/1982 | European Pat. Off. . |
| 3311170 | 4/1987 | Fed. Rep. of Germany . |
| 2440875 | 6/1980 | France . |
| 1111952 | 7/1984 | U.S.S.R. . |

OTHER PUBLICATIONS

Brochure entitled "Packaging for Profit and Promotion" published by 3M Packaging Systems Division.

Brochure entitled "3M-Matic TM S-857 L Clip Applicator" published by 3M Packaging Systems Division.

Brochure entitled "The AccuGlide TM FLC Film L Clip Taping Head from 3M" published by 3M Packaging Systems Division.

*Primary Examiner*—David A. Simmons
*Assistant Examiner*—William J. Matney, Jr.
*Attorney, Agent, or Firm*—Gary L. Griswold; Walter N. Kirn; Peter L. Olson

[57] ABSTRACT

The present invention relates to an apparatus for applying an L-clip of pressure sensitive tape to each of a series of objects driven past the apparatus. The apparatus includes a tape applying device including an application member for applying and a cutting member for severing a piece of pressure sensitive adhesive tape.

16 Claims, 4 Drawing Sheets

APPARATUS FOR APPLYING TAPE TO AN OBJECT

TECHNICAL FIELD

This invention relates to an apparatus for applying a length of pressure sensitive adhesive tape to an object driven past the device along a predetermined path. Specifically, the apparatus of the present invention applies an L-clip of pressure sensitive adhesive tape to a leading edge of succeeding cartons as each is driven through the apparatus.

BACKGROUND OF THE INVENTION

In the packaging field it is useful to seal containers, particularly cartons, with pressure sensitive adhesive tape. Two common types of cartons are the display carton (also known as a telescopic design box) and the regular slotted carton (also known as a regular slotted container, or RSC). The display carton includes a lower tray portion, in which the contents of the carton are placed, and an upper closure portion that covers the tray portion. The tray portion and the closure portion are adapted to fit together, typically with the tray portion inside the closure portion, and to be sealed by adhering one or more pieces of tape across the lower leading and lower trailing edges.

The regular slotted carton is generally a rectangular parallelepiped, including an upright leading surface, upright trailing surface, two side surfaces, and matching top and bottom surfaces. The top and bottom surfaces each include a flap connected to each of the upper and lower edges of the leading and trailing surfaces, and a flap connected to the upper and lower edge of each of the side surfaces, which flaps are folded inwardly to close the carton. The flaps connected to the edges of the leading and trailing surfaces are typically folded inwardly first, and the flaps connected to the edges of the side walls folded second, which positions the side wall flaps in abutting relationship along the length of the top surface and the bottom surface. To seal the carton, a section of tape may be applied to the flaps along the interface therebetween to adhere them together. For simplicity, the upper surface of the carton will be understood to include the abutting flaps, and the flaps comprising the lower surface of the carton will be referred to as the lower surface. The upper and lower surfaces will also be referred to jointly as longitudinal surfaces herein.

Devices are known which will automatically seal the upper or lower surface of a carton with tape as the carton is being driven past the device. Exemplary of such devices U.S. Pat. No. 4,789,418 (Rayl). The '418 patent discloses an apparatus that includes a tape head for applying an L-clip of tape to the leading surface and the lower surface of a carton, as well as to the lower surface and trailing surface of the carton. An "L-clip" refers to a piece of tape that is adhered to a portion of the leading surface, across the leading edge, and to a longitudinal surface of a carton or other object, because the cross-sectional shape of the tape section resembles a capital "L". One or more L-clips may also be applied across the lower leading edge, the lower trailing edge, or the upper trailing edge, depending upon the apparatus that is used.

The tape applicator of the '418 patent includes an application roller that is initially located in the path of the object, and has one end of a continuous supply of adhesive tape disposed thereon. The adhesive side of the tape is presented for contact with the leading surface of the carton as the carton is urged against the application roller. After the application roller contacts the leading surface of the carton, the roller is pivoted away from the carton by a pneumatic cylinder to a position beneath and spaced from the bottom surface of the carton. A blade severs the tape, and a wipedown assembly including two buffing rollers presses the tape against the leading and bottom surfaces of the carton to ensure adhesion thereto. A similar process is followed to adhere an L-clip of tape to the lower trailing corner of the carton. The apparatus of the '418 patent also includes a stripper assembly designed to strip tape from a tape supply and to maintain tension of the tape during the application process, which assembly adds cost and complexity to the tape applying apparatus.

One design consideration that is important in the carton sealing field regards the impact force and the application force of the application member against the carton. The impact force is applied by the application roller when it initially contacts the leading surface of the carton, and must be controlled in order to prevent the roller from compressing, denting, or crushing the leading surface or the contents of the carton. The application force is applied by the application roller as it traverses the leading surface of the carton, and must also be controlled for the reasons previously mentioned. The control of impact and application forces is particularly important when the object to which the L-clip is being applied is thin-walled, underfilled, or otherwise susceptible of damage.

Other types of tape applicators are also known. For example, U.S. Pat. No. 4,238,269 (Deering, Jr.) discloses a C-clip applicator, meaning that the apparatus applies a continuous length of pressure sensitive adhesive tape to a portion of the leading surface of a carton, across the top surface of the carton to seal the abutting flaps together, and to a portion of the trailing surface of the carton. As with the L-clip applicator, the C-clip applicator is so named because the cross-sectional view of the segment of tape used to seal the carton resembles the letter "C".

One feature of the apparatus of the '269 patent is the application of a uniform force by the applying roller against the leading surface of the carton being sealed. The application member is adapted for movement generally linearly in response to the application of force thereto by a carton. The '269 application member was therefore an improvement over previously designed application members that pivot about a fixed axis, due to the increasing compressive forces applied by a pivoting application arm to the corner of the carton being sealed.

While having its own utility, the apparatus of the '269 patent is directed to a C-clip applicator rather than an L-clip applicator, and it therefore addresses a distinct problem. For example, a C-clip applicator is not required to sever a section of tape at a point intermediate the longitudinal surface of the carton. Furthermore, although the application member of the '269 patent applied a low uniform force to the leading surface of a carton, it would be even more desirable to eliminate the application force completely. It is therefore desirable to provide an simple and inexpensive apparatus for applying an L-clip of pressure sensitive adhesive tape to a leading edge of an object while eliminating the application forces applied by the application member to the object.

SUMMARY OF THE INVENTION

The present invention provides for a tape applying apparatus for applying a section of tape having an adhesive coating disposed on one face to an object. The object has a leading surface and a longitudinal surface adjacent the leading surface which joins thereto to define a leading edge, and is moving along an object path relative to the apparatus. The apparatus comprises (a) a device frame; (b) a tape supply means mounted on the device frame for providing a continuous length of tape to the apparatus; (c) an application member having an arcuate periphery; (d) a support arm for supporting the application member, the support arm having a longitudinal axis; (e) first shifting means connected to the support arm for shifting the support arm from an extended position wherein the application member is in the object path to a retracted position wherein the application member is located above the longitudinal surface, the first shifting means fixedly connected to the device frame for shifting said support arm with respect thereto; (f) means for defining a tape path extending from the tape supply means to the arcuate periphery of the application member with the adhesive coating of the tape presented by the application member for contact with the leading surface of the object; (g) means for severing a section of tape from the tape supply means; (h) second shifting means connected to the severing means for shifting the severing means between a retracted position away from the tape path and an extended position at or through the tape path when the support arm is in the retracted position, the second shifting means fixedly connected to the device frame for shifting the severing means with respect thereto; (i) a first sensor for transmitting a first signal when the object initially contacts the tape, the first signal thereby enabling the first shifting means to shift the support arm from the extended position to the retracted position to locate the application member above the longitudinal surface of the object; and (j) a second sensor for transmitting a second signal when the support arm reaches the retracted position and the leading surface of the object is further along the object path than is the application member, the second signal thereby enabling the second shifting means to shift the severing means from the retracted position to the extended position, thereby severing the section of tape from the tape supply means; the first shifting means adapted to return the support arm to the extended position and the second shifting means adapted to return the severing means to the retracted position, after the tape has been severed.

Also provided is an apparatus for applying L-clips of tape having a pressure sensitive adhesive on one face thereof to each in a series of objects being driven along an object path. Each object has a leading surface and a longitudinal surface joining at a leading edge. The apparatus comprises, in addition to the elements disclosed above, a support frame including a bed upon which the objects are supported; means for moving the objects along the object path atop the bed; a pair of opposed sidewalls affixed to the support frame for guiding the objects along the object path; and an upper frame extending from said support frame.

BRIEF DESCRIPTION OF THE DRAWINGS

The invention will be more readily understood with reference to the accompanying drawings, wherein like reference numerals refer to like components throughout the several views, and wherein.

DETAILED DESCRIPTION OF THE INVENTION

Figure 1:
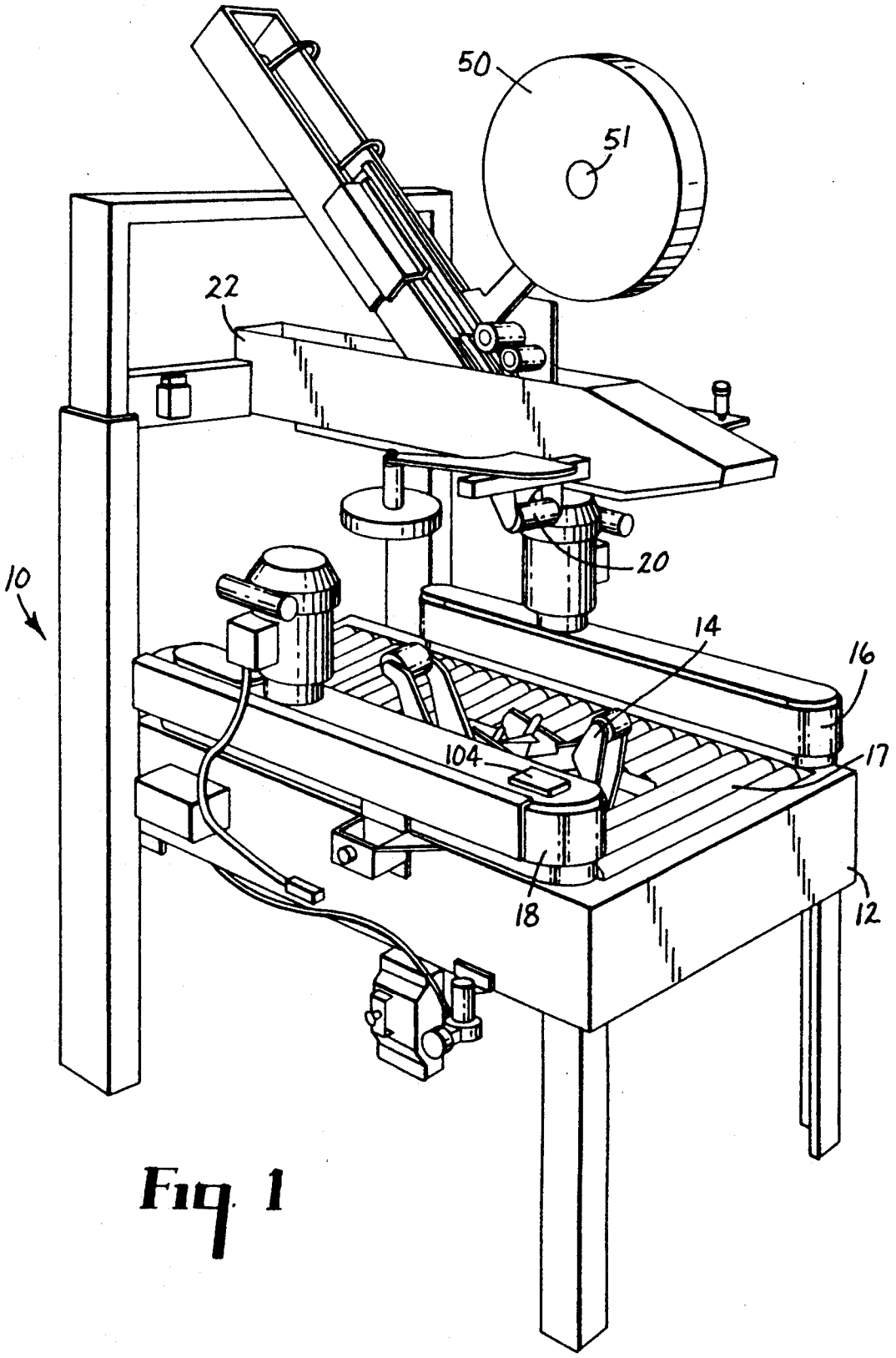
FIG. 1 is a perspective view of an apparatus including the L-clip applicator of the present invention.

Referring now to FIG. 1, there is illustrated an apparatus 10 including a base portion 12 supporting a lower tape applying device 14 and including spaced conveyers 16 and 18 adapted to grip the sides of an object and to propel the object over bed 17 and past upper tape applying device 20 along an object path. Apparatus 10 includes means for adjusting conveyers 16 and 18 relative to each other to positions at which they will engage the side surfaces of objects with different widths to propel the objects along the object path. Upper frame 22 supports upper tape applying device 20, and is adapted to adjust vertically to bring upper tape applying device 20 to a level for contact with the leading surface of an object propelled through apparatus 10. Such means are not described in detail herein because they are well known in the art, as illustrated by case sealer catalog nos. 200A and 700A, sold by Minnesota Mining and Manufacturing Company of St. Paul, Minn. under the name 3M-Matic ®.

Although the present invention has utility in applying an L-clip of tape to each of a series of objects propelled past the device, it has particular utility in the application of an L-clip to the leading edge of a carton, such as a display carton or regular slotted carton. Although the embodiments of the present invention are most frequently described with reference to the application of an L-clip of tape to such a carton, the present invention is not limited to cartons. Other objects having a leading surface and an adjacent longitudinal surface that join at a leading edge (e.g. stacks of sheet goods or filled, gusseted bags) are also included within the scope of the invention. For simplicity, however, a carton will be used in the described embodiments as a representative object.

Figure 2:
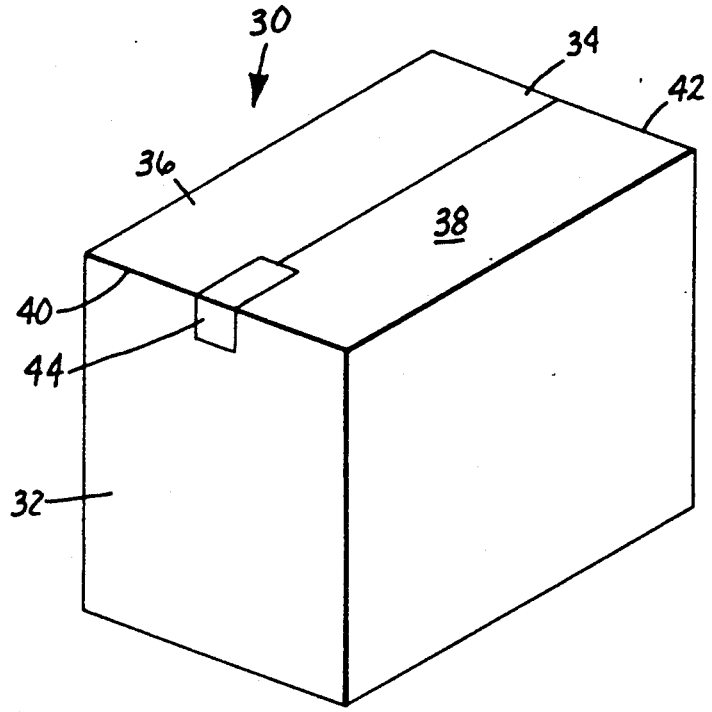
FIG. 2 is a perspective view of a representative carton sealed with an L-clip of tape by an apparatus according to the present invention.

FIG. 2 illustrates a carton 30 sealed using the apparatus of the present invention. Carton 30 includes a leading surface 32 and a longitudinal surface 34 comprising flaps 36 and 38, which may be folded into abutting relationship to close the carton. Leading surface 32 and longitudinal surface 34 join at leading edge 40, and longitudinal surface 34 and the trailing surface (not shown) join at trailing edge 42. Tape section 44 is applied along a portion of leading surface 32, across leading edge 40, and along a portion of the interface between flaps 36 and 38 to form the L-clip that seals the carton.

Upper tape applying device 20 is shown in FIGS. 3-7, and includes a tape supply means which supplies a continuous length of tape 52. In the illustrated embodiment, the tape supply means includes tape roll 50 supported on tape hub 51, as shown in FIG. 1. Also shown are means for defining a tape path, shown in the illustrated embodiment as rollers 54, 56, 58, and 60, which guide tape 52 from tape roll 50 to application member 70. Rollers 54 and 56 are mounted on upper frame 22, and rollers 58 and 60 are mounted on support arm 72, which will be described further below. Numerous different configurations of rollers or other members are suitable equivalents of the illustrated tape path means.

It should be noted that roller 56 of the illustrated embodiment is preferably a one-way roller. A one-way roller, capable of rotation in only one direction, assists in preventing backlash of the tape following the cutting step, which will be described in greater detail below. Roller 56 is also preferably a constant tension roller, which assists in maintaining a constant tension on the tape regardless of the characteristics of the tape supply. Thus a stripper assembly is not necessary with the apparatus of the present invention, as contrasted to the apparatus of the '418 patent. Rollers 54, 58, and 60 are shown as idler rollers in the illustrated embodiment, and could be modified, relocated or even eliminated depending on the specific configuration of the apparatus.

Rollers 58, 60, and application member 70 are supported by support arm 72, which is adapted for linear motion along longitudinal axis A—A. Application member 70 has an arcuate periphery, and is shown in the illustrated embodiment as a roller, although a fixed application member having an arcuate periphery may also have utility. The angle between axis A—A and the horizontal may be varied depending on the properties of the carton and the parameters of the sealing system. The preferred angle of axis AA with respect to longitudinal surface 34 is preferably between 35° and 55°, and is most preferably about 45°.

Figure 3:
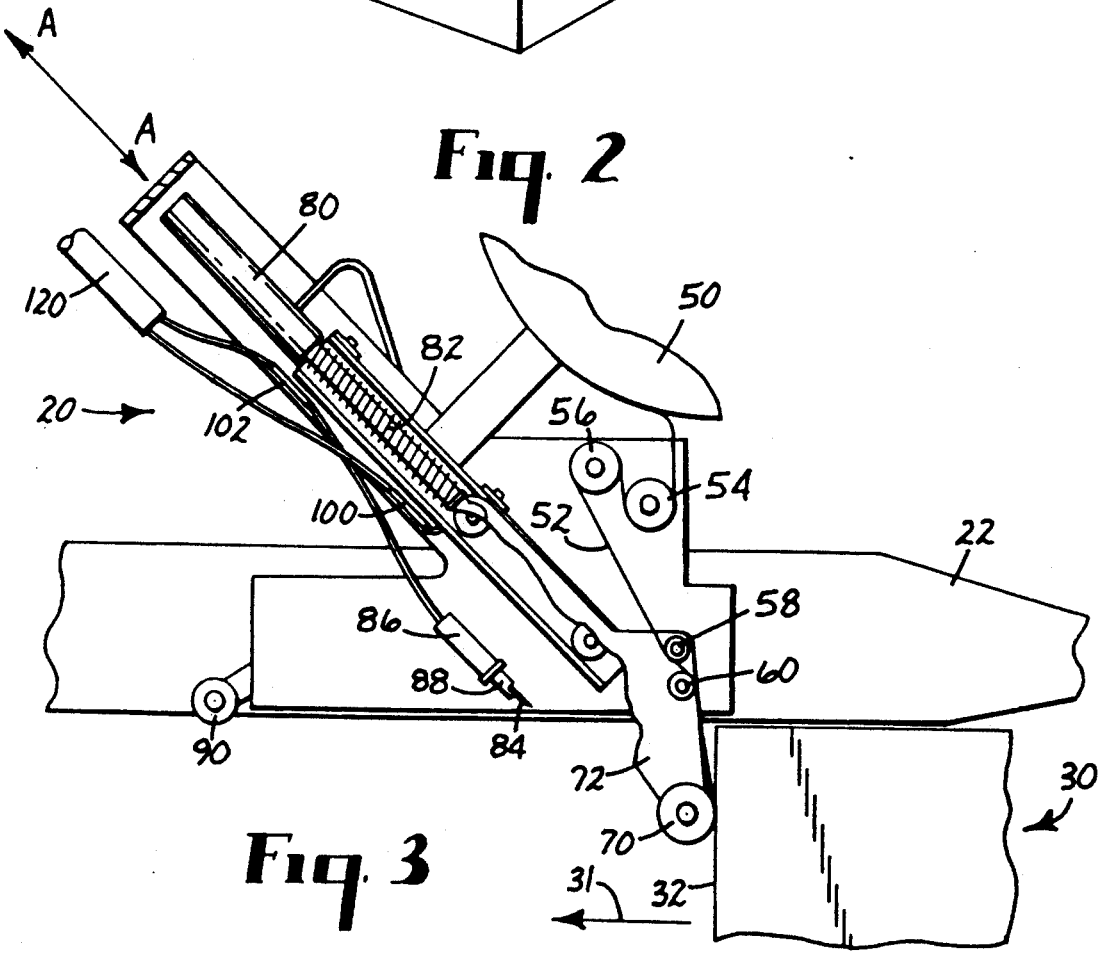
FIGS. 3 through 7 illustrate succeeding positions of a carton as it moves through the apparatus of the present invention.
Figure 6:
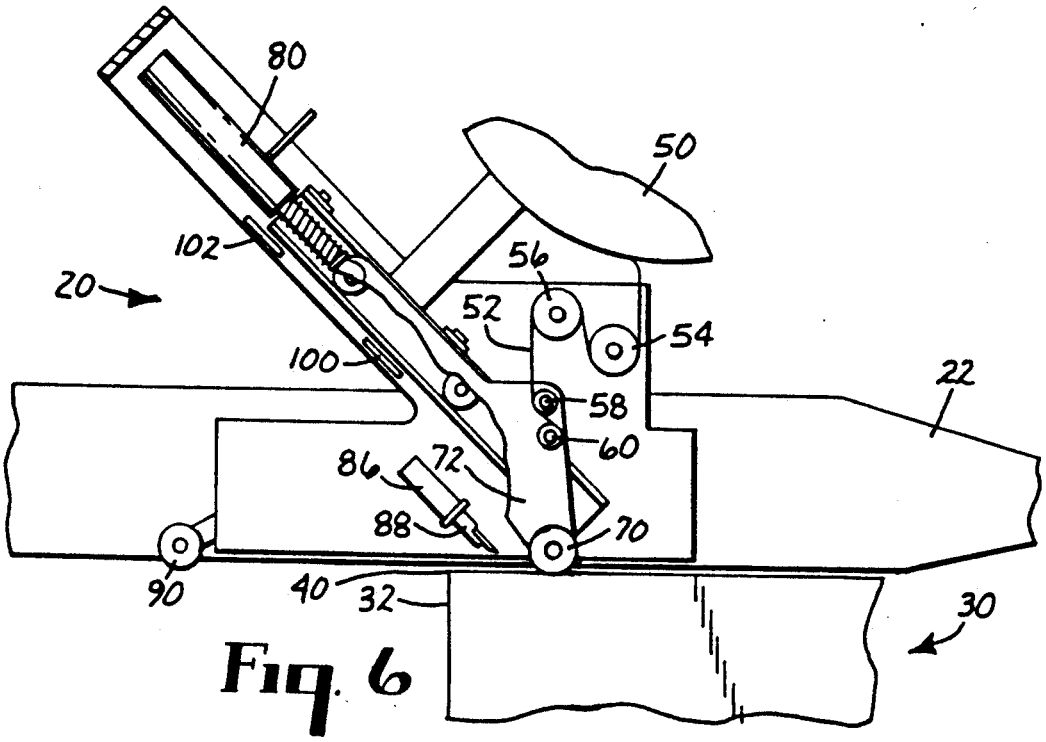
Figure 4:
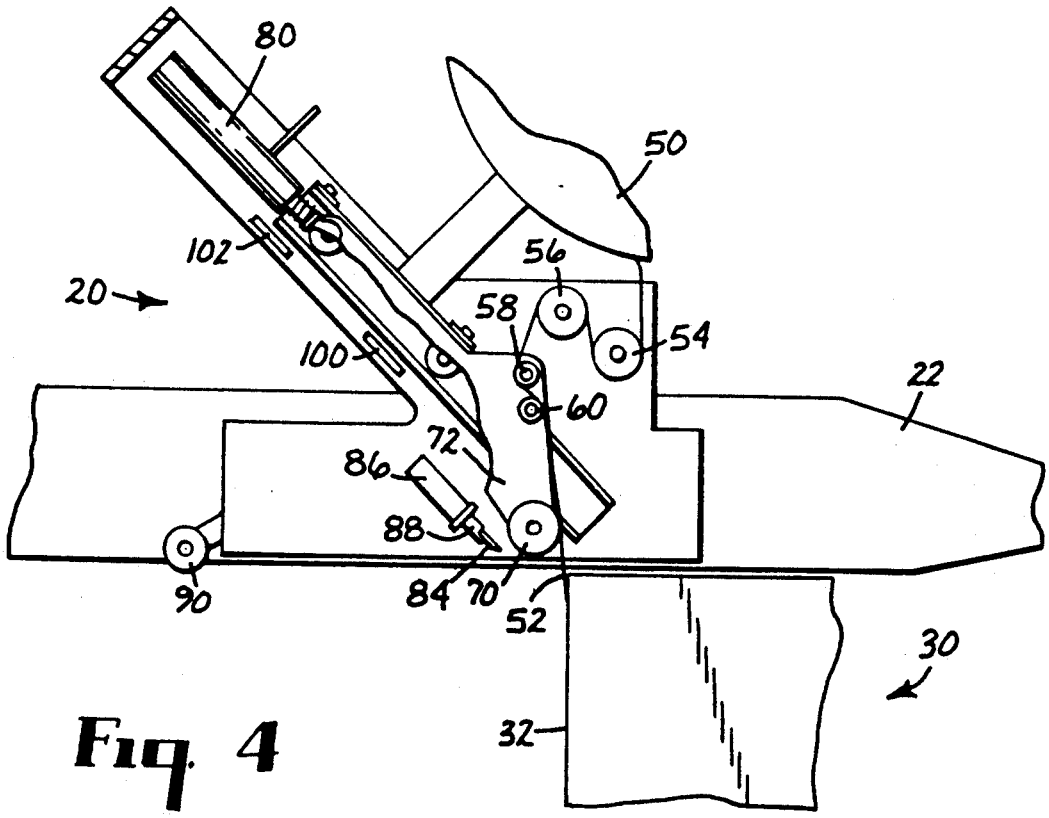

Also provided are first shifting means, which means are attached to upper frame 22, and are adapted to shift support arm 72 from an extended position to a retracted position responsive to a signal. The first shifting means are shown in the illustrated embodiment as pneumatic cylinder 80 and piston 82, and will be collectively referred to as cylinder 80. When support arm 72 is in the extended position, application member 70 is positioned for contact with leading surface 32 of carton 30, as shown in FIG. 3. When cylinder 80 shifts support arm 72 to the retracted position, application member 70 is located above longitudinal surface 34 of carton 30, as shown in FIG. 4. The retracted position allows carton 30 to pass beneath application member 70 to withdraw tape from tape source 50.

Cylinder 80 is preferably a single-action pneumatic cylinder, meaning that it withdraws support arm 72 into the retracted position upon receipt of a pneumatic signal and then automatically allows support arm 72 to return to the extended position. A pneumatic cylinder having a 6" stroke and a ¾" bore has been shown to have utility in connection one embodiment of the present invention. Such a cylinder is available from, for example, the Bimba Manufacturing Co. of Monee, Ill. Cylinder 80 could also comprise other like devices, including those comprising hydraulically or electrically activated piston and cylinders, solenoids, cams, screws, and the like.

Because the objects to which an L-clip are applied by the present invention may be susceptible to puncture or damage (e.g. corrugated cardboard cartons, gusseted paper bags), it is a further advantage of the present invention that the tape applying device applies minimal level of impact force when it contacts the leading surface of the carton, and can be adapted so that the application member 70 does not contact the leading surface of the object after the initial impact. This is accomplished by shifting cylinder 80 into the retracted position immediately after carton 30 contacts tape 52 and application member 70, which can lower the impact force and eliminate application forces applied by the application member 70 to the object.

Cylinder 80 withdraws support arm 72 into the retracted position responsive to a signal transmitted by a first sensor. As used with reference to this invention, "sensor" defines an apparatus for perceiving the position of either carton 30 or of a component of apparatus 10, and for transmitting a signal responsive thereto. Although two separate sensors are shown and described in the preferred embodiment of the present invention, it should be understood that a greater or lesser number of sensors, appropriately designed and positioned, may perform the functions of the two sensors described with reference to the preferred embodiment, while remaining within the scope of the invention. The signal transmitted may be mechanical, electrical, hydraulic, or the like, and in the preferred embodiment described below, the signal is pneumatic.

Figure 5:
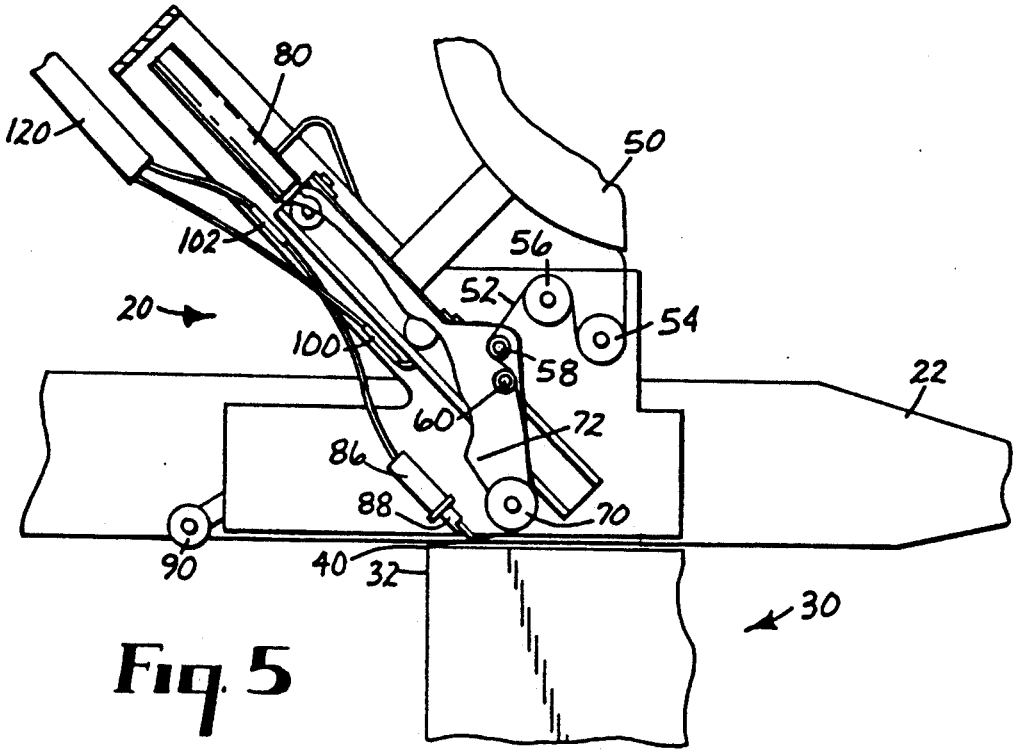
Figure 7:
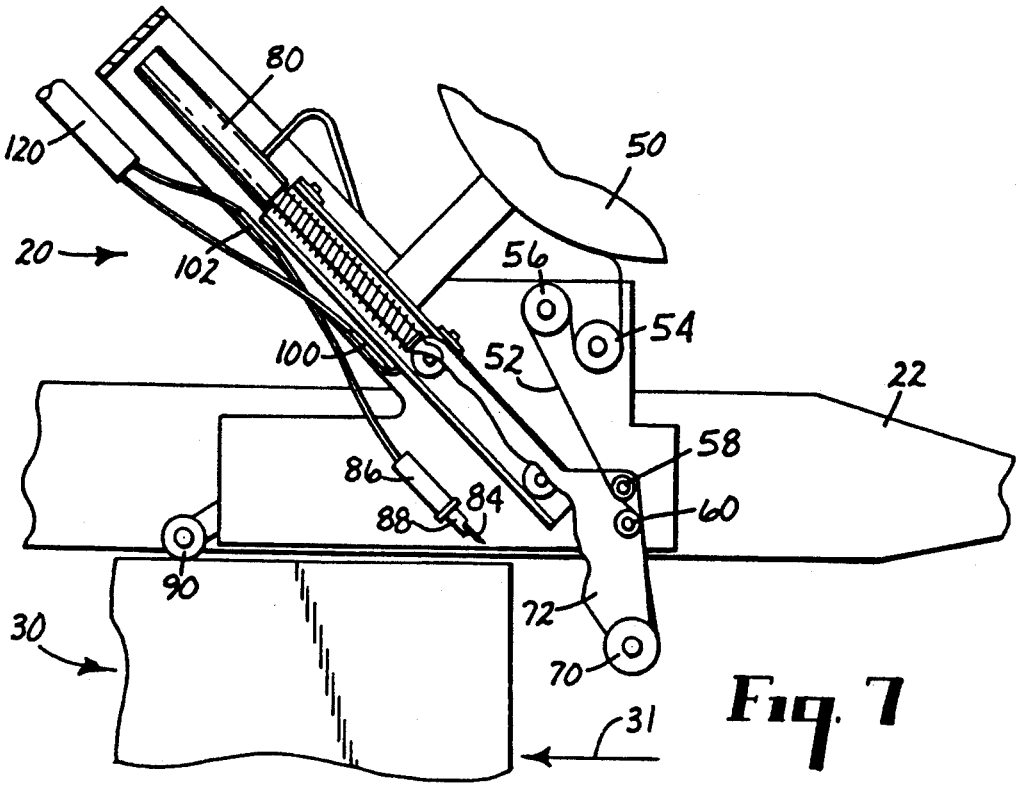

The first sensor, shown in the illustrated embodiment as first pneumatic limit switch 100, is triggered by the position of support arm 72 and transmits a signal to cylinder 80. Pneumatic limit switches that may be used with the present invention are commonly available from, for example, the Micro Switch Co. of Freeport, Ill. First switch 100 is positioned to be triggered immediately after carton 30 contacts application member 70 (typically by adapting first switch 100 to close just after support arm 72 moves in response to the initial impact of the carton against the application member), in order to minimize the impact force and preferably eliminate the application force. First switch 100 is preferably interposed between compressed air source 120 and cylinder 80, and is positioned such that it permits compressed air to flow therethrough after support arm is displaced due to the impact force of carton 30 meeting application member 70. The pneumatic circuit connecting compressed air source 120 to cylinder 80 thus includes first switch 100, as shown in FIGS. 3, 5 and 7. The function of first switch 100 will be described in greater detail below with reference to the operation of the apparatus of the present invention.

Also provided are means for severing a length of pressure sensitive adhesive tape from tape roll 50. In the illustrated embodiment, the severing means is shown as cutting member 84, but could comprise any other cutting means known in the art, including but not limited to a heated member (e.g. a blade or wire), a serrated blade, a laser, or the like. Cutting member 84 is connected to second shifting means, shown in the illustrated embodiment as pneumatic cylinder 86 and piston 88, for shifting cutting member 84 from a retracted to an extended position. Pneumatic cylinder 86 is connected to upper frame member 22, and piston 88 is attached to cutting member 84. For simplicity, piston 88 and pneumatic cylinder 86 will be referred to collectively herein as cylinder 86.

Cylinder 86 is adapted to shift cutting member 84 from a retracted position into an extended position responsive to a signal from a second sensor, indicated schematically in FIGS. 3–7 and further described below. When in the extended position, cutting member 84 extends through the tape path, cutting a section of tape from the tape roll 50. In the preferred embodiment, cylinder 86 is a pneumatic, single-acting, non-rotating cylinder, having a ½" stroke and a 7/16" bore, which has been shown to have utility in one embodiment of the present invention. Such a cylinder is commonly available from, for example, the Bimba Manufacturing Co. of Monee, Ill. The single action feature of the cylinder returns cutting member 84 to the retracted position automatically after cutting member 84 has reached the extended position. In the retracted position, cutting member 84 is prepared for activation during subsequent cycles. Cylinder 86 is preferably non-rotating in order to maintain the transverse position of cutting member 84 with respect to the longitudinal direction of tape 52. The second shifting means could also comprise any other means known in the art described above with reference to the first shifting means.

Cylinder 86 extends cutting member 84 into the extended position responsive to a signal from a second sensor, shown in the illustrated embodiment as second pneumatic limit switch 102. Second switch 102 is triggered by the retracted position of support arm 72 and transmits a signal to cylinder 86 to shift cutting member 84 into the extended position to cut tape 52. Second switch 102 is preferably interposed between compressed air source 120 and cylinder 86, in order to permit air to flow therebetween only when second switch 102 is closed responsive to the retracted position of support arm 72. The pneumatic circuit connecting compressed air source 120 to cylinder 86 therefore includes second switch 102, which is positioned so as to detect the retracted position of support arm 72, as shown in FIGS. 3, 5 and 7.

Many types of tape are suitable for use with the present invention, but film tape is preferred over filament tape because film tape is easier to cut. Film box sealing tape identified by numbers 372, 373, 375, 355, and 600, are each available from Minnesota Mining and Manufacturing Company of St. Paul, Minn. and each has been shown to have utility in conjunction with the present invention. Tapes of different widths may also be used, including tapes measuring in the preferred range of 1" to 3" wide.

Means may also be provided for buffing the trailing edge of the L-clip. In the illustrated embodiment, buffing means are shown as buffing roller 90. Buffing roller 90 is supported by upper frame 22, and presses the portion of the L-clip applied to the longitudinal surface of the carton thereagainst. The buffing means could also be fixedly connected to the upper frame, and should preferably comprise a curved periphery. If a highly aggressive pressure sensitive adhesive tape is used with the apparatus of the present invention, it is possible that the buffing means could be eliminated, if the tape becomes sufficiently attached to the carton of its own accord.

Operation of the Apparatus

FIGS. 3–7 illustrate the operation of the apparatus through succeeding positions of carton 30 and upper tape applying device 20 as an L-clip is applied to carton 30 by the apparatus of the present invention. Carton 30 is moving along an object path in a direction 31 with respect to tape applying device 20, as shown in FIG. 3. FIG. 3 illustrates application member 70 in its initial position, with tape 52 presented with an adhesive side toward leading surface 32 of carton 30. Support arm 72 is in an extended position, cutting member 84 is in a retracted position, and tape 52 is prepared to contact carton 30 as carton 30 moves along the object path. As carton 30 contacts tape 52 and application member 70, first switch 100 is triggered by the change in position of support arm 72 due to contact with the moving carton. Compressed air flows from the source of compressed air 120 to cylinder 80, enabling cylinder 80 to withdraw support arm 72 into the retracted position.

FIG. 4 illustrates upper tape applying device 20 in an intermediate position. Carton 30 has advanced along the object path, and support arm 72 has been shifted by cylinder 80 into the retracted position in response to the input of compressed air to cylinder 80. Application member 70 is located above leading edge 40, and tape 52 has been applied to a portion of leading surface 32 by application member 70.

In FIG. 5, support arm 72 remains in the retracted position, and application member 70 remains raised above longitudinal surface 34 of carton 30. Leading edge 40 is further along the object path than is application member 70, and tape 52 extends between leading edge 40 and application member 70. Second switch 102 is positioned to detect the retracted position of support arm 72, and to transmit a signal responsive thereto. In the preferred embodiment, support arm 72 is progressively withdrawn into the retracted position as carton 30 continues to be propelled past application member 70. Upon reaching the retracted position, as shown in FIG. 5, the support arm triggers second switch 102, enabling compressed air to flow to cylinder 86. Cylinder 86 then shifts cutting member 84 into the extended position to sever tape 52. Second switch 102 could also be positioned such that it transmits a second signal responsive to encountering carton 30, rather than the position of support arm 72.

It should be understood that in the preferred embodiment, the coordinated operation of second switch 102, second cylinder 86, and cutting member 84 is completed in a relatively short period of time. This enables first cylinder to shift support arm 72 into the retracted position momentarily while tape 52 is being severed, and then to allow support arm 72 to return toward the extended position due to the single action feature of the preferred embodiment of cylinder 80. Thus support arm 72, in the preferred embodiment of the present invention, is not retained in the retracted position, but is retracted only for as long as it takes to sever the tape, and released. After it is released, support arm 72 will shift toward the extended position until application member 70 contacts longitudinal surface 34 of carton 30, after which application member 70 will traverse longitudinal surface 34 until it reaches trailing edge 42.

As shown in FIG. 7, carton 30 continues to move along the object path in direction 31, and application member 70 eventually passes trailing edge 42. As application roller 70 rolls past trailing edge 42 of carton 30, support arm 72 returns to the extended position. Buffing roller 90 presses tape 52 against longitudinal surface 34 of carton 30, in order to secure adherence thereto. In the extended position, application member 70 is again located in the path of succeeding cartons, and tape 52 is presented with the adhesive side facing away from application member 70 for engagement with the next carton.

Another feature of the present invention allows the size of the L-clip to be varied depending on the application. Furthermore, the position of upper frame 22 may be varied to accommodate cartons of different sizes. For example, it may be desirable to seal a short, wide carton using an L-clip that has a short portion along the leading surface and a longer portion along the longitudinal surface. In such a case, the position of upper frame 22 is adjusted so that application member 70 contacts the box at a point near the leading edge of the carton. The position of second switch 102 is adjusted to permit application arm 72 to retract further, allowing carton 30 to withdraw tape 52 for a longer time before second switch 102 signals cutting member 84 to sever tape 52. Other adjustments could be made to apply an L-clip of other dimensions, such as one having a longer piece applied to the leading surface and a shorter piece applied to the longitudinal surface.

In one embodiment, the present invention also provides a global safety switch 104, which prevents the pneumatic circuits from being activated unless an object is in the object path. As shown in FIG. 1, safety switch 104 is positioned to close when a carton passes switch 104, which enables the pneumatic circuits to be activated as above described.

The present invention has now been described with reference to several embodiments thereof. It will be apparent to those skilled in the art that many changes can be made in the embodiments described without departing from the scope of the invention. Thus, the scope of the present invention should not be limited to the structures described herein, but only by structures described by the language of the claims and the equivalents of those structures.

We claim:

1. A tape applying apparatus for applying a section of tape having an adhesive coating disposed on one face to an object having a leading surface and a longitudinal surface adjacent the leading surface which joins thereto to define a leading edge, the object moving along an object path relative to the apparatus, the apparatus comprising:

(a) a device frame;

(b) a tape supply means mounted on said device frame for providing a continuous length of tape to the apparatus;

(c) an application member having an arcuate periphery;

(d) a support arm for supporting said application member, said support arm having a longitudinal axis;

(e) first shifting means connected to said support arm for shifting said support arm from an extended position wherein said application member is in the object path to a retracted position wherein said application member is located above the longitudinal surface, said first shifting means fixedly connected to said device frame for shifting said support arm with respect thereto responsive to a first signal;

(f) means for defining a tape path extending from said tape supply means to said arcuate periphery of said application member with the adhesive coating of the tape presented by said application member for contact with the leading surface of the object;

(g) means for severing a section of tape from said tape supply means;

(h) second shifting means connected to said severing means for shifting said severing means between a retracted position away from said tape path and an extended position at or through said tape path when said support arm is in said retracted position, said second shifting means fixedly connected to said device frame for shifting said severing means with respect thereto responsive to a second signal;

(i) a first sensor for transmitting a first signal to said first shifting means when the object initially encounters said application member, thereby signaling said first shifting means to shift said support arm from said extended position to said retracted position to locate said application member above the longitudinal surface of the object; and (j) a second sensor for transmitting a second signal to said second shifting means when said support arm reaches said retracted position and the leading surface of the object is further along the object path than is said application member, thereby signaling said second shifting means to shift said severing means from said retracted position to said extended position, thereby severing the section of tape from said tape supply means, said first shifting means adapted to return said support arm to said extended position and said second shifting means adapted to return said severing means to said retracted position, after said tape has been severed.

2. The apparatus of claim 1, wherein said apparatus further comprises means for buffing said section of tape against said object, said means connected to said device frame.

3. The apparatus of claim 1, wherein said application member comprises a roller rotatively mounted on said support arm.

4. The apparatus of claim 1, wherein said first and second sensors comprise first and second pneumatic limit switches and said first and second shifting means comprise first and second pneumatic pistons and cylinders, and wherein said first pneumatic limit switch is connected to a source of compressed air and to said first pneumatic piston and cylinder, and wherein said second pneumatic limit switch is connected to a source of compressed air and to said second pneumatic piston and cylinder, and wherein said first and second signals comprise transmission of compressed air through said first and second pneumatic limit switches.

5. The apparatus of claim 1, wherein said means for defining a tape path comprise a plurality of rollers, at least one of which is a one-way, constant tension roller.

6. The apparatus of claim 1, wherein said severing means comprises a blade.

7. The apparatus of claim 1, wherein said tape supply means comprises a tape roll rotatively mounted on a hub supported by said device frame.

8. An apparatus for applying L-clips of tape having a pressure sensitive adhesive on one face thereof to each in a series of objects being driven along an object path, each object having a leading surface and a longitudinal surface joining at a leading edge, the apparatus comprising:

(a) a support frame including a bed upon which the objects are supported;

(b) means for moving the objects along the object path atop said bed;

(c) a pair of opposed sidewalls affixed to said support frame for guiding the objects along the object path;

(d) a tape supply means for providing a continuous length of tape to the apparatus;

(e) an upper frame extending from said support frame;

(f) a tape applying device mounted on said upper frame, said device comprising:

(i) a device frame;

(ii) a tape supply means mounted on said device frame for providing a continuous length of tape to the apparatus;

(iii) an application member having an arcuate periphery;

(iv) a support arm for supporting said application member, said support arm having a longitudinal axis;

(v) first shifting means connected to said support arm for shifting said support arm from an extended position wherein said application member is in the object path to a retracted position wherein said application member is located above the longitudinal surface, said first shifting means fixedly connected to said device frame for shifting said support arm with respect thereto responsive to a first signal;

(vi) means for defining a tape path extending from said tape supply means to said arcuate periphery of said application member with the adhesive coating of the tape presented by said application member for contact with the leading surface of the object;

(vii) means for severing a section of tape from said tape supply means;

(viii) second shifting means connected to said severing means for shifting said severing means between a retracted position away from said tape path and an extended position at or through said tape path when said support arm is in said retracted position, said second shifting means fixedly connected to said device frame for shifting said severing means with respect thereto responsive to a second signal;

(ix) a first sensor for transmitting a first signal to said first shifting means when the object initially encounters said application member, thereby signaling said first shifting means to shift said support arm from said extended position to said retracted position to locate said application member above the longitudinal surface of the object; and (x) a second sensor for transmitting a second signal to said second shifting means when said support arm reaches said retracted position and the leading surface of the object is further along the object path than is said application member, thereby signaling said second shifting means to shift said severing means from said retracted position to said extended position, thereby severing said section of tape from said tape supply means, said first shifting means adapted to return said support arm to said extended position and said second shifting means adapted to return said severing means to said retracted position, after said tape has been severed.

9. The apparatus of claim 8, wherein said upper frame includes means for adjusting the height of said upper frame relative to the object to enable said application member to present said tape for contact with said leading surface at a predetermined location.

10. The apparatus of claim 8, wherein said tape applying device further comprises means for buffing said tape section against the object, said means connected to said device frame.

11. The apparatus of claim 8, wherein said application member comprises a roller rotatively mounted on said support arm.

12. The apparatus of claim 8, wherein said first and second sensors comprise first and second pneumatic limit switches and said first and second shifting means comprise first and second pneumatic pistons and cylinders, and wherein said first pneumatic limit switch is connected to a source of compressed air and to said first pneumatic piston and cylinder, and wherein said second pneumatic limit switch is connected to a source of compressed air and to said second pneumatic piston and cylinder, and wherein said first and second signals comprise transmission of compressed air through said first and second pneumatic limit switches.

13. The apparatus of claim 8, wherein said means for defining a tape path comprise a plurality of rollers, at least one of which is a one-way, constant tension roller.

14. The apparatus of claim 8, wherein said severing means comprises a blade.

15. The apparatus of claim 8, wherein said tape supply means comprises a tape roll rotatively mounted on a hub supported by said device frame.

16. A tape applying apparatus for applying a section of tape having an adhesive coating disposed on one face to a carton having a leading surface and a top surface adjacent the leading surface which joins thereto to define a leading edge, the carton moving along an object path relative to the apparatus, the apparatus comprising:

(a) a device frame;

(b) a tape roll mounted on said device frame for providing a continuous length of tape to the apparatus;

(c) a cylindrical application roller;

(d) a support arm for rotatively supporting said application roller, said support arm having a longitudinal axis;

(e) a first pneumatic piston and cylinder for cooperatively shifting said support arm from an extended position wherein said application roller is in the object path to a retracted position wherein said application roller is located above the top surface, said first cylinder fixedly connected to said device frame, and said first piston slidably disposed within said first cylinder and connected to said support arm for cooperatively shifting said support arm with respect to said device frame responsive to a first pneumatic signal;

(f) a plurality of rollers adapted to define a tape path extending from said tape roll to said application roller with the adhesive coating of the tape presented for contact with the leading surface of the carton by said application roller;

(g) a blade for severing a section of tape from said tape roll;

(h) a second pneumatic piston and cylinder for cooperatively shifting said blade between a retracted position away from said tape path and an extended position at or through said tape path when said support arm is in said retracted position, said second cylinder fixedly connected to said device frame, and said second piston slidably disposed within said second cylinder and connected to said blade for shifting said blade with respect to said device frame responsive to a second pneumatic signal;

(i) a first pneumatic limit switch connected to a source of compressed air, for transmitting a first pneumatic signal to said first piston and cylinder when the carton initially encounters said application member, said first piston and cylinder thereby shifting said support arm from said extended position to said retracted position to locate said application roller above the top surface of the carton; and (j) a second pneumatic limit switch connected to a source of compressed air, for transmitting a second pneumatic signal to said second piston and cylinder to cooperatively shift said blade from said retracted position to said extended position to sever the section of tape from said tape roll when said support arm reaches said retracted position and the leading surface of the carton is further along the object path than is said application roller;

said first piston and cylinder adapted to cooperatively return said support arm to said extended position and said second piston and cylinder adapted to cooperatively return said blade to said retracted position, after said tape has been severed.

* * * * *